US012059072B2

(12) United States Patent
Meyer et al.

(10) Patent No.: US 12,059,072 B2
(45) Date of Patent: Aug. 13, 2024

(54) GUIDE DEVICE FOR A MOVEABLE FURNITURE PART

(71) Applicant: Paul Hettich GmbH & Co. KG, Kirchlengern (DE)

(72) Inventors: Bernd Meyer, Petershagen (DE); Britta Kloss, Bielefeld (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 329 days.

(21) Appl. No.: 17/610,494

(22) PCT Filed: May 4, 2020

(86) PCT No.: PCT/EP2020/062306

§ 371 (c)(1),
(2) Date: Nov. 11, 2021

(87) PCT Pub. No.: WO2020/233967

PCT Pub. Date: Nov. 26, 2020

(65) Prior Publication Data

US 2022/0232974 A1 Jul. 28, 2022

(30) Foreign Application Priority Data

May 17, 2019 (DE) ..... 10 2019 113 071.9

(51) Int. Cl.
*A47B 88/477* (2017.01)

(52) U.S. Cl.
CPC ..... *A47B 88/477* (2017.01)

(58) Field of Classification Search
CPC ..... A47B 88/477; A47B 88/467
See application file for complete search history.

(56) References Cited

U.S. PATENT DOCUMENTS

| | | | | |
|---|---|---|---|---|
| 7,926,630 | B2 * | 4/2011 | Baldreich | A47B 88/467 188/205 R |
| 9,285,160 | B1 | 3/2016 | Kang | |
| 2009/0273129 | A1 * | 11/2009 | Zimmer | A47B 88/467 267/170 |
| 2013/0026899 | A1 | 1/2013 | Babucke-Runte et al. | |
| 2013/0104339 | A1 * | 5/2013 | Shimizu | E05F 1/16 16/72 |

(Continued)

FOREIGN PATENT DOCUMENTS

| | | |
|---|---|---|
| CN | 101991283 A | 3/2011 |
| CN | 104703512 A | 6/2015 |

(Continued)

OTHER PUBLICATIONS

International Search Report dated Jun. 4, 2020 issued in PCT/EP2020/062306 (with English translation).

(Continued)

*Primary Examiner* — Daniel J Rohrhoff
(74) *Attorney, Agent, or Firm* — Collard & Roe, P.C.

(57) ABSTRACT

A guide device for a moveable furniture part, in particular a drawer, has a catch which is moveable along a guide track and which is pretensioned by an energy store and which is moveable at least between a parked position with a tensioned energy store and an end position with a less tensioned energy store. The energy store can be coupled to an activator between the parked position and the end position in order to transmit a braking or acceleration force to the moveable furniture part, and wherein the activator has a metal support part.

10 Claims, 9 Drawing Sheets

(56) References Cited

U.S. PATENT DOCUMENTS

| | | | | |
|---|---|---|---|---|
| 2014/0294328 | A1* | 10/2014 | Pecar | A47B 88/467 384/20 |
| 2015/0204129 | A1* | 7/2015 | Park | E05F 5/003 16/66 |
| 2015/0289648 | A1* | 10/2015 | Bachor | A47B 88/40 312/334.46 |
| 2018/0132615 | A1* | 5/2018 | Kim | F16C 29/02 |
| 2018/0306236 | A1* | 10/2018 | Liu | F16C 29/005 |
| 2019/0069672 | A1* | 3/2019 | Pan | A47B 88/467 |
| 2021/0169221 | A1* | 6/2021 | Lee | A47B 88/931 |
| 2021/0186213 | A1* | 6/2021 | Chen | A47B 88/473 |
| 2022/0053933 | A1* | 2/2022 | Chen | A47B 88/49 |

FOREIGN PATENT DOCUMENTS

| | | | |
|---|---|---|---|
| CN | 104840166 | A | 8/2015 |
| CN | 105758104 | A | 7/2016 |
| CN | 108903400 | A | 11/2018 |
| DE | 102011053840 | A1 | 3/2013 |
| DE | 102012109751 | A1 | 4/2014 |
| DE | 102017119772 | A1 | 2/2019 |
| EP | 2374369 | A1 | 10/2011 |
| EP | 2465381 | A1 | 6/2012 |
| JP | 2008264438 | A | 11/2008 |

OTHER PUBLICATIONS

German Search Report dated Jan. 29, 2020 issued in the corresponding German Application DE 10 2019 113 071.9 (with English translation of relevant parts).

Chinese Office Action in Application No. 202080036182.1, issued Feb. 28, 2023 with English translation thereof.

* cited by examiner

GUIDE DEVICE FOR A MOVEABLE FURNITURE PART

CROSS REFERENCE TO RELATED APPLICATIONS

This application is the National Stage of PCT/EP2020/062306 filed on May 4, 2020, which claims priority under 35 U.S.C. § 119 of German Application No. 10 2019 113 071.9 filed on May 17, 2019, the disclosures of which are incorporated by reference. The international application under PCT article 21(2) was not published in English.

BACKGROUND OF THE INVENTION

The present invention relates to a guide device for a moveable furniture part, in particular a drawer, comprising a catch which is moveable along a guide track and which is pretensioned by an energy store and which is moveable at least between a parked position with a tensioned energy store and an end position with a less tensioned energy store, wherein the energy store can be coupled to an activator between the parked position and the end position in order to transmit a braking or acceleration force to the moveable furniture part, wherein the activator has a metal support part.

DE 10 2011 053 840 A1 discloses a retraction device for installation in a pull-out guide, in which a catch is moveable along a guide and can be coupled to an activator over a certain travel section. The catch is connected to a damper and to an energy store so that, when the catch is coupled to the activator, forces are generated for braking and retracting a moveable furniture part. Such retraction devices have proven useful, but the use of a metal activator can lead to increased noise being produced at the time the activator is coupled to the catch. In addition, sharp edges may be formed on the activator, which increases the risk of injury when assembling an item of furniture.

SUMMARY OF THE INVENTION

The object of the present invention is therefore to create a guide device for a moveable furniture part which is able to provide high forces for braking or acceleration, but which produces less noise at the time of coupling and presents a reduced risk of injury.

This object is achieved by a guide device having the features of claim 1.

The guide device according to the invention comprises an activator having a metal support part which, at least in an area of contact with a catch, is provided with a cover made of plastic. As a result, the catch no longer strikes against a metal component at the time of coupling to the activator, but instead strikes against the cover made of plastic, which reduces noise. The cover additionally ensures that sharp edges on the metal support part are covered, which improves handling.

The cover preferably comprises a protrusion which is formed with a rounded surface and which engages in a U-shaped receptacle on the catch. The rounded protrusion may have a surface which slides along a contact surface on the catch, so that low friction forces are present in the contact area. The cover preferably has two spaced-apart protrusions, and each protrusion bears at one side against a contact surface with the catch. This ensures a stable coupling between the activator and the catch.

The metal support part is preferably arranged at least partially within the cover and within a U-shaped receptacle of the catch. The receptacle on the catch is preferably formed between two contact surfaces, and the metal support part is arranged at least partially within these two contact surfaces. As a result, high forces at the time the catch strikes against the activator can be dissipated directly into the metal support part, thereby reducing the risk of breakage of the cover made of plastic. The cover made of plastic is substantially subjected to pressure since the cover is arranged in the direction of action of the forces between the metal support part and the contact surface on the catch.

For easy manufacture, the cover may be produced by overmoulding around the metal support part. This ensures that the cover is arranged in a play-free manner.

The metal support part preferably has a mounting plate and a retaining part which protrudes from the mounting plate and to which the cover is fixed. As a result, the metal mounting plate can be used for connection to a moveable furniture part, for example for welding to a rail of a pull-out guide. The cover is arranged only on the protruding retaining part. In this case, the retaining part may fill at least one opening with plastic so as to be secured against being pulled off. Preferably, the retaining part is non-detachably fixed to the metal support element. The retaining part may have at least one, preferably two, protruding webs which are oriented at an angle to the mounting plate and which, in a position coupled to the catch, engage in the receptacle of the catch. The web is preferably designed to be elastically deformable so as to be able to absorb the impact energy at the time of striking against the catch.

In order to support the cover in a stable manner, the web is preferably arranged at least partially within the cover and within the U-shaped receptacle of the catch.

The guide device according to the invention is used in particular in a pull-out guide, but may also be used in sliding door fittings or other linearly moveable fittings.

The invention will be explained in greater detail below on the basis of an exemplary embodiment and with reference to the accompanying drawings, in which:

BRIEF DESCRIPTION OF THE DRAWING FIGURES

DETAILED DESCRIPTION OF THE INVENTION

Figure 1A:
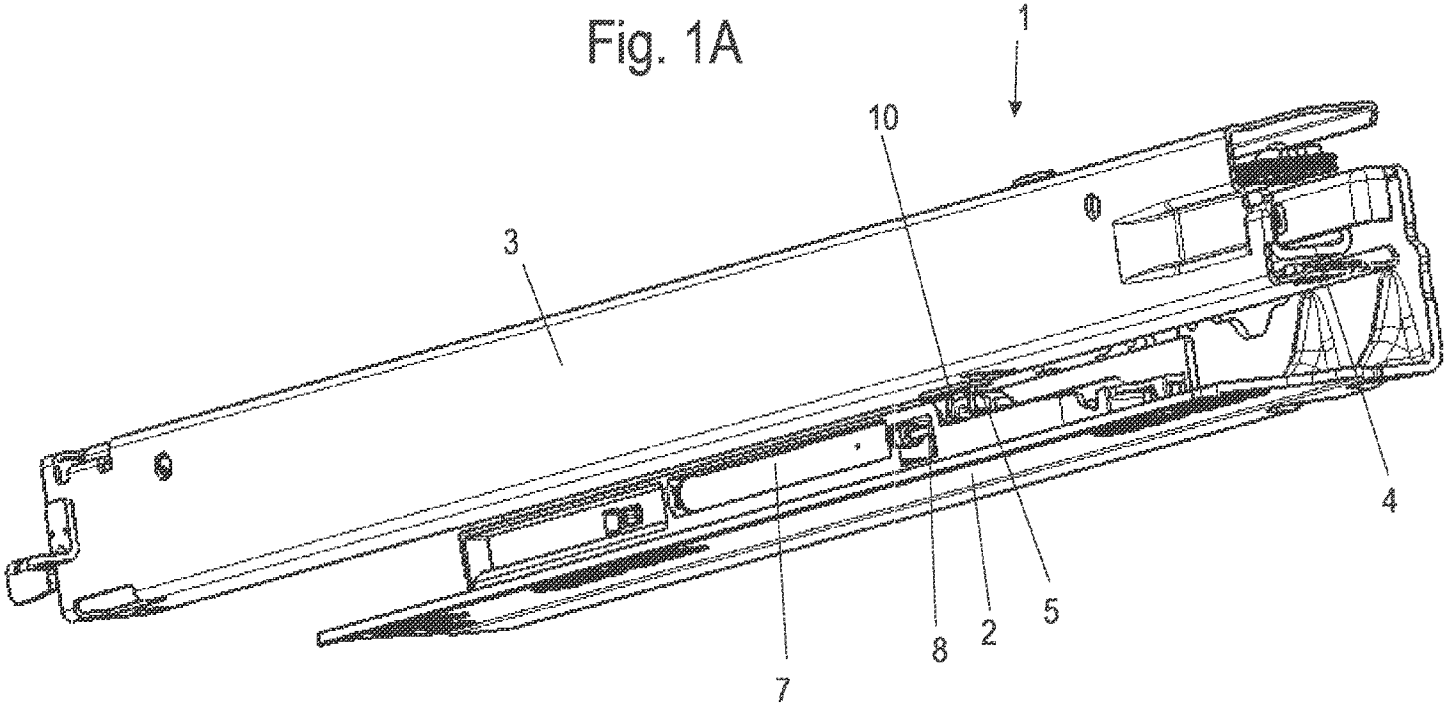
FIGS. 1A and 1B show two views of a pull-out guide with a guide device according to the invention in a retracted position.
Figure 1B:
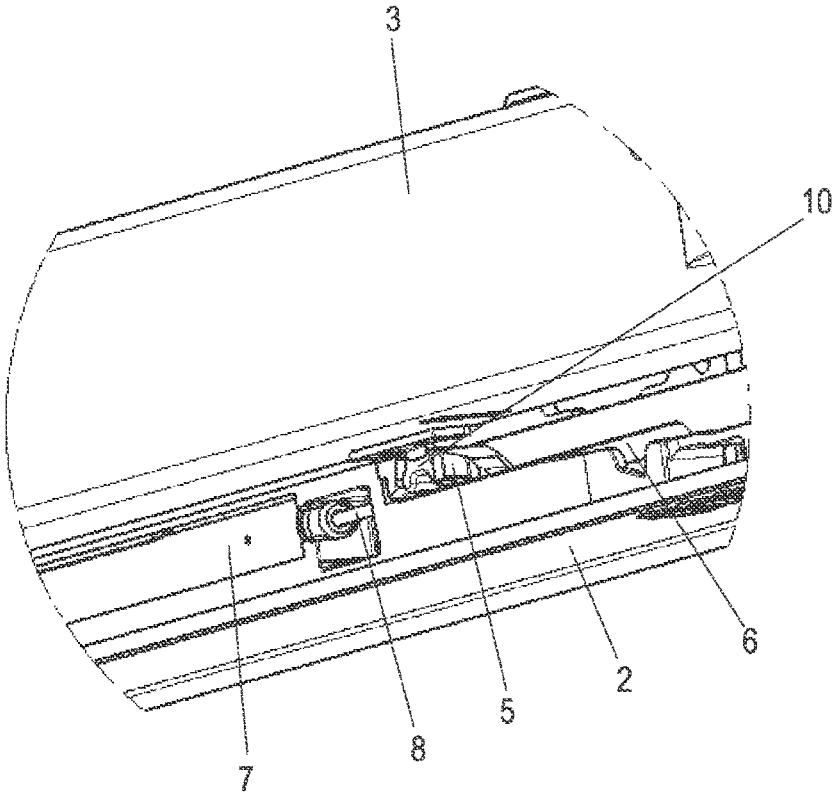

A pull-out guide 1 comprises a stationary rail 2, which is fixed to a furniture body or household appliance and on which a moveable rail 3 is provided, wherein an optionally arranged middle rail 4 is provided between the stationary rail 2 and the moveable rail 3. A guide device is located between the stationary rail 2 and the moveable rail 3 in order to exert acceleration or braking forces during a movement of the moveable rail 3.

The guide device comprises a catch 5 which is moveable along a guide track 6 on a housing. The guide track may extend substantially linearly. At least at one side, the guide track has an angled end portion, at which the catch 5 can pivot in order to release a coupling between the catch 5 and an activator 10. In this exemplary embodiment, the activator 10 is fixed to the moveable rail 3, while the guide track 6 with the housing is fixed to the stationary rail 2. It is of course also possible to fix the housing with the guide track 6 to the moveable rail 3 and to fix the activator 10 to the stationary rail 2.

The guide device further comprises an energy store for retracting or ejecting the catch 5. In the exemplary embodiment shown, a damper in the form of a linear damper is also provided, having a damper housing 7 and a piston rod 8 which is coupled to the catch 5 in order to brake the catch 5 as it moves into the retracted position. The guide device may be designed substantially as shown in DE 10 2011 053 840, with the activator 10 being modified.

Figure 2A:
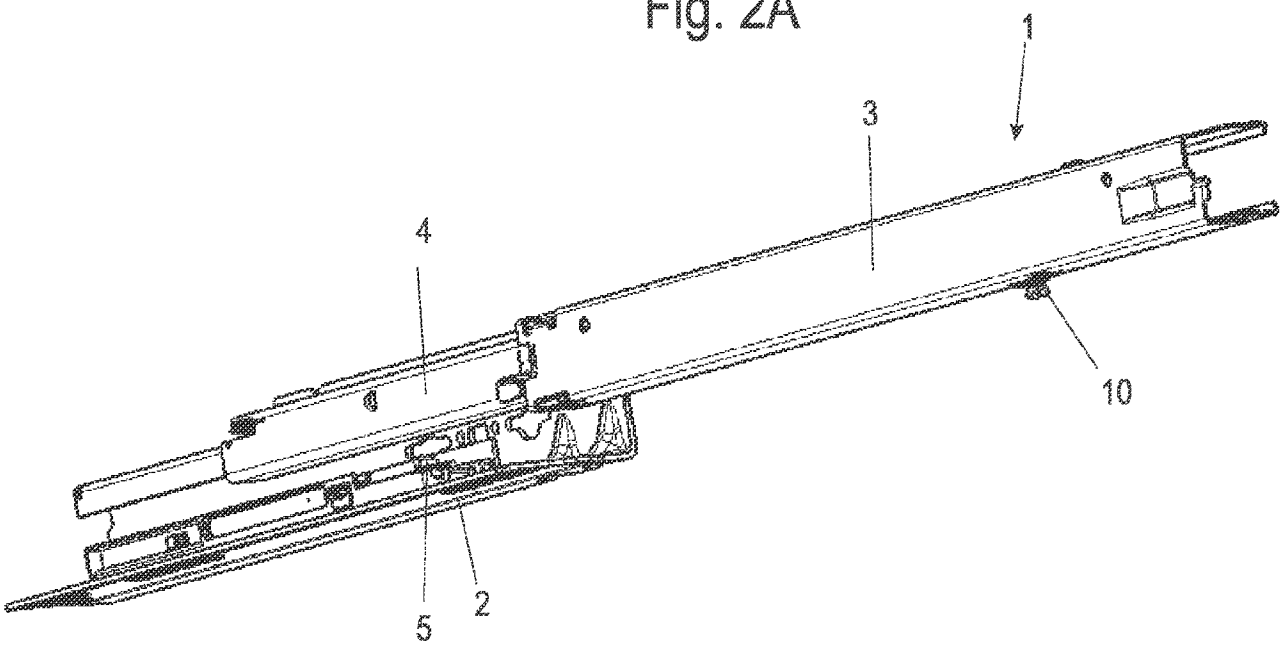
FIGS. 2A to 2C show several views of the pull-out guide of FIG. 1 in an extended position.
Figure 2B:
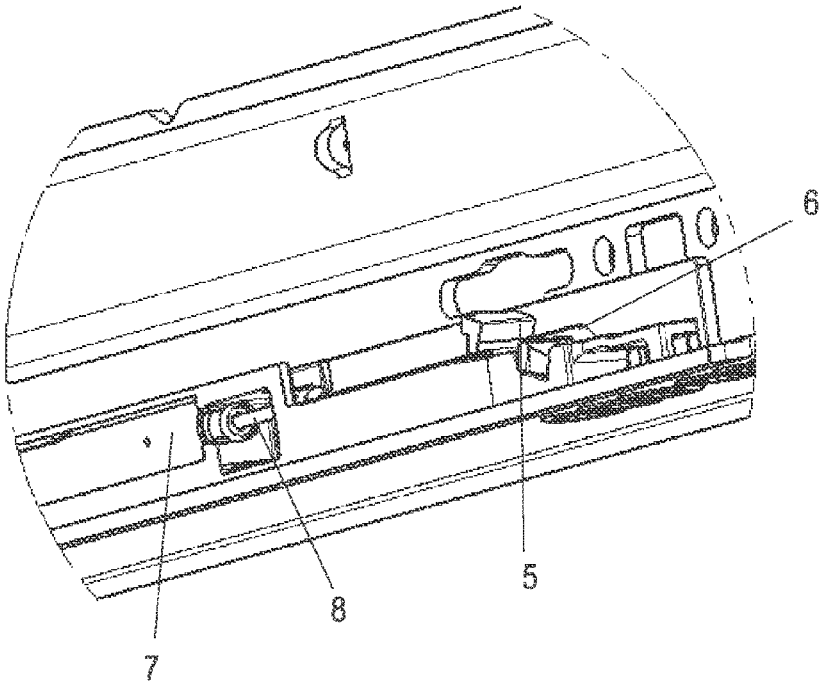
Figure 2C:
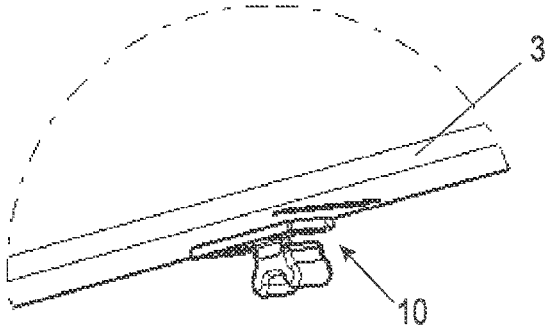

FIGS. 2A and 2B show the pull-out guide 1 in an extended position. The activator 10 is decoupled from the catch 5 and is located on the protruding moveable rail 3. The catch 5 is parked in the parked position at an angled end portion of the guide track 6. From this position, the activator 10 on the moveable rail 3 can activate the catch 5 in order then to be braked by the damper for the last travel section of the movement of the moveable rail 3 and to be moved into a retracted position by an energy store. An unpleasant noise may be produced at the time the activator 10 strikes against the catch 5.

Figure 3A:
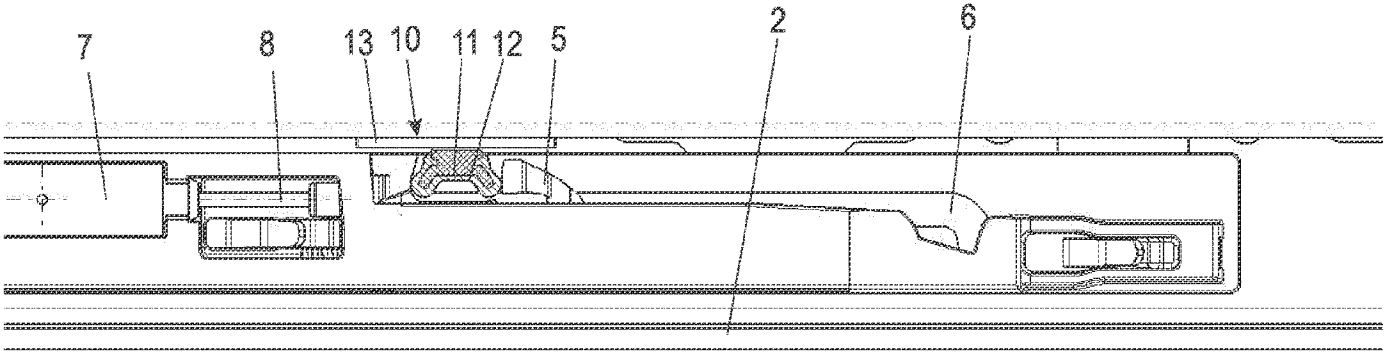
FIGS. 3A to 3C show several views of the pull-out guide of FIG. 1 in different positions.

FIG. 3A shows the activator 10 in engagement with the catch 5, the latter having a U-shaped receptacle within which the activator 10 is arranged. The activator 10 in this case comprises a metal support part 11, which has a mounting plate 13 that is fixed to the moveable rail 3, preferably by welding. The metal support part 11 is arranged at least partially within the receptacle on the catch 5 and is provided in this region with a cover 12 made of plastic. As a result, a contact area of the catch 5 is located not directly on the metal support part 11 of the activator 10, but rather on the cover 12 made of plastic, which has a rounded surface and thus ensures low friction as the activator moves relative to the catch 5. In addition, the risk of injury can be reduced by covering the sharp-edged support part 11.

Figure 3B:
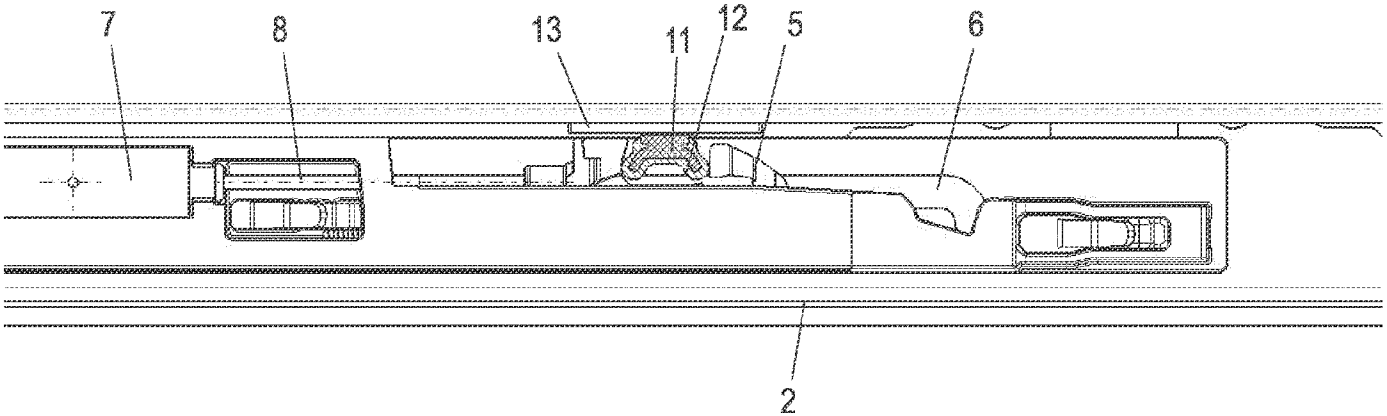
Figure 3C:
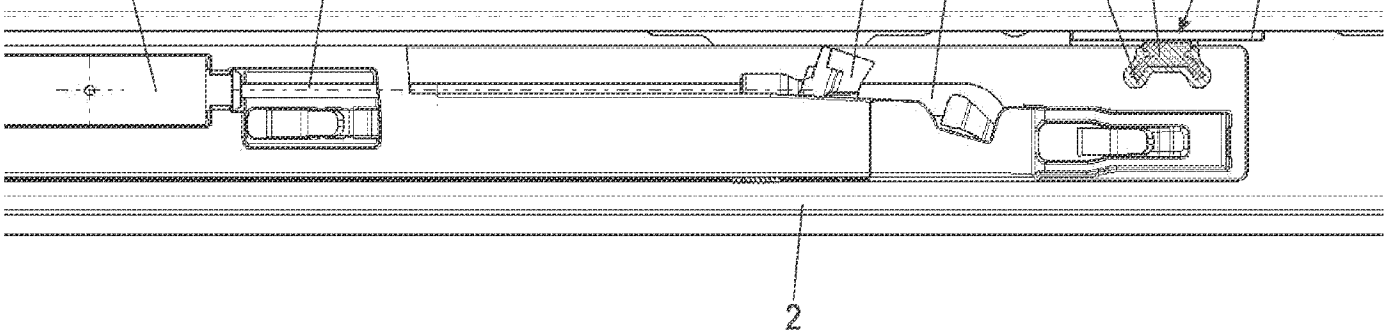

In FIG. 3B, the moveable rail 3 has been moved relative to the stationary rail 2 by a movement of the activator 10, and therefore the catch 5 has also been moved along the guide track 6 counter to the force of the energy store, with the piston rod 8 being pulled out of the damper housing 7. If the moveable rail 3 is moved further in the pull-out direction, the position shown in FIG. 3C is reached, in which the catch 5 has been pivoted at the angled end portion of the guide track 6 in order to release the activator 10. The activator 10 is thus moveable independently of the catch 5. When the moveable rail 3 is moved back in the closing direction, it comes into engagement with the catch 5, wherein only a little noise is produced when the activator 10 strikes at high speed since the metal support part 11 is covered with plastic by the cover 12 in the contact area.

Figure 4A:
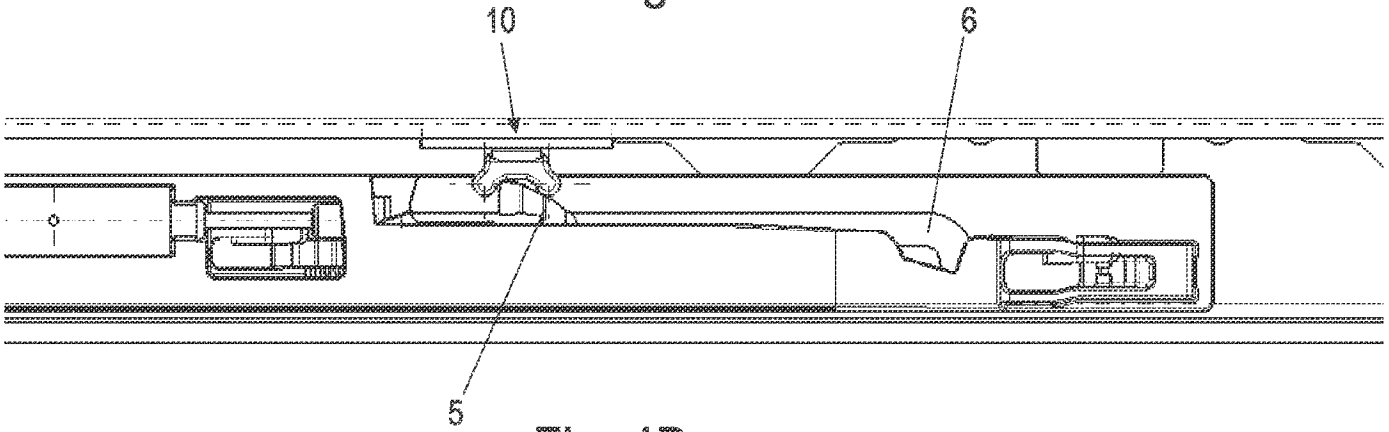
FIGS. 4A and 4B show two views of the pull-out guide of FIG. 1 at the time of coupling to the catch.
Figure 4B:
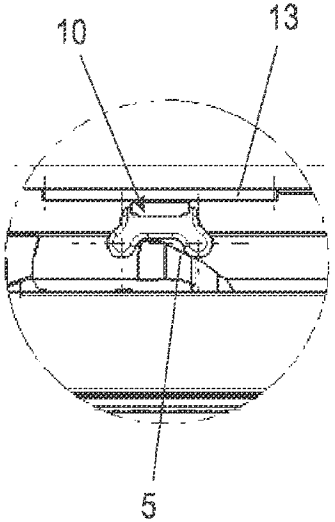

FIGS. 4A and 4B show a further variant of the coupling of the activator 10 to the catch 5. The activator 10 and the catch 5 have a certain elasticity and flexibility in order to be able to make a coupling even when the catch 5 is arranged in the end position on the guide track 6 and the moveable rail with the activator 10 then strikes against an arm of the catch 5, which is bent jointly with the activator 10 until the activator 10 couples into the catch 5.

Figure 5A:
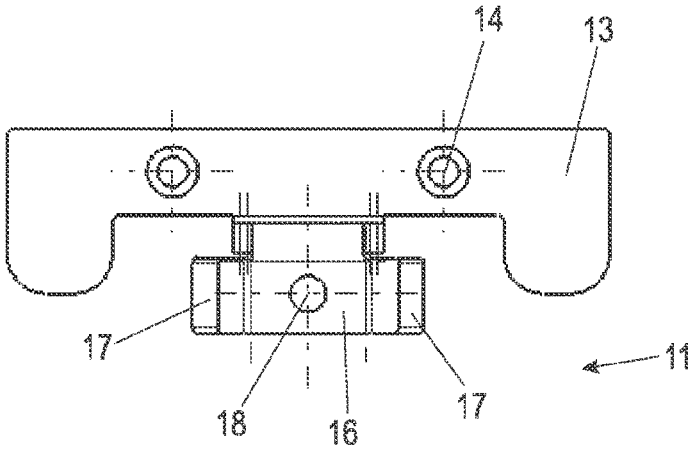
FIGS. 5A to 5C show several views of a metal support part of the activator.
Figure 5B:
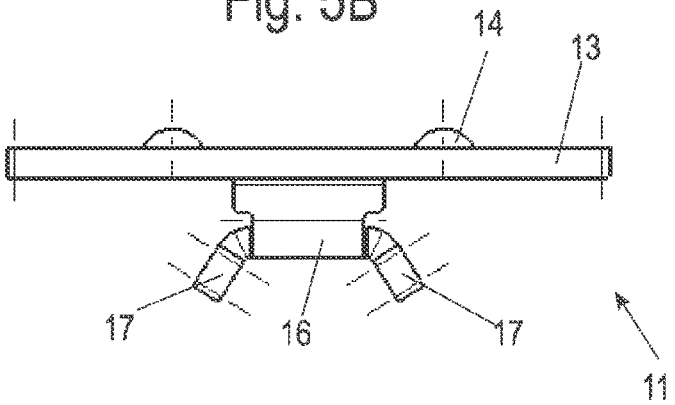
Figure 5C:
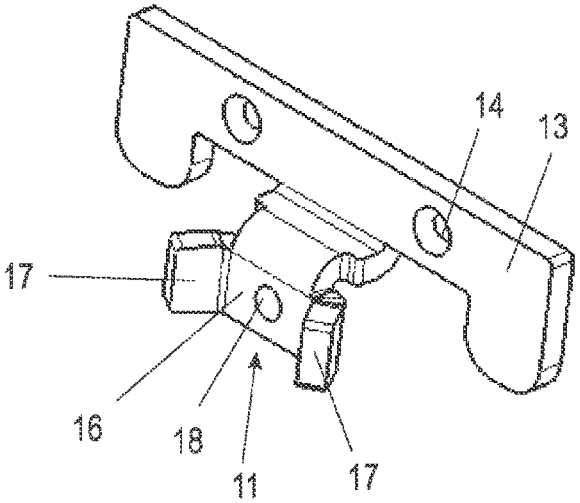

FIGS. 5A to 5C show the metal support part 11 of the activator 10. The metal support part 11 comprises a mounting plate 13 which is fixed to the moveable rail 3 of the pull-out guide 1 by way of two fastening points 14, in particular welded joints. Protruding from this mounting plate 13 is a retaining part 16, which is panel-shaped and from which two webs 17 extend, said webs being arranged at an angle and being oriented in an inclined manner relative to the plane of the mounting plate 13, for example between 20° and 70°. An opening 18 is formed on the retaining part 16, which opening can be filled by plastic material of the cover 12.

Figure 6A:
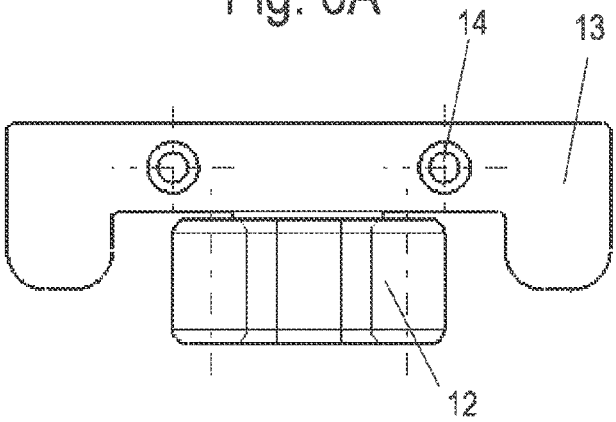
FIGS. 6A to 6C show several views of the activator of the guide device.
Figure 6B:
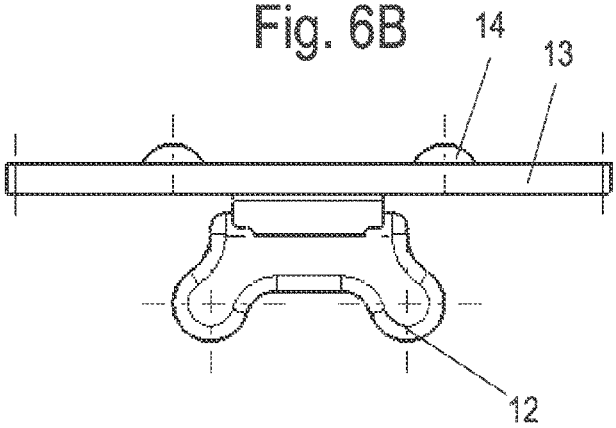
Figure 6C:
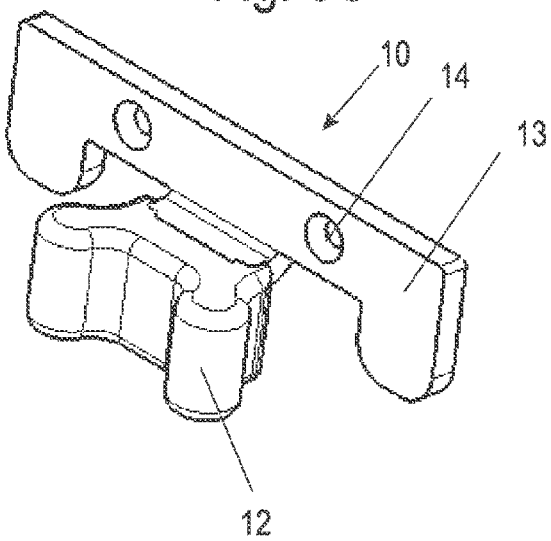

FIGS. 6A to 6C show the activator 10 with the metal support part 11 and the cover 12. The cover 12 is preferably produced by overmoulding around the metal support part 11, wherein it is not the entire support part 11 that is overmoulded, but rather only the retaining part 16 which is formed integrally with the non-overmoulded mounting plate 13. The cover 12 comprises two protrusions having a rounded surface, wherein each protrusion can bear with one region against a contact surface on the catch 5. The rounded surface is in this case substantially cylindrical in a protruding portion.

In the exemplary embodiment shown, the activator 10 is used on a pull-out guide 1. It is also possible to use the guide device with the activator 10 on a sliding door fitting.

In addition, in the exemplary embodiment shown, the use of the actuator 10 is described by way of example on a so-called self-closing mechanism. It is also possible that the guide device is designed as a self-opening mechanism or also as an ejecting device.

LIST OF REFERENCE SIGNS

1 pull-out guide
2 rail
3 rail
4 middle rail
5 catch
6 guide track
7 damper housing
8 piston rod
10 activator
11 support part
12 cover
13 mounting plate
14 fastening point
16 retaining part
17 web
18 opening

What is claimed is:

1. A guide device configured for guiding a moveable furniture part, comprising a catch (5) which is moveable along a guide track (6) and which is pretensioned by an energy store and which is moveable at least between a parked position with a tensioned energy store and an end position with a less tensioned energy store, wherein the energy store is configured to be coupled to an activator (10) between the parked position and the end position in order to transmit a braking or acceleration force to the moveable furniture part, wherein the activator (10) has a metal support part (11), and wherein the metal support part (11), at least in an area of contact with the catch (5), is provided with a cover (12) made of plastic, wherein the support part (11) has a mounting plate (13) and a retaining part (16) which protrudes from the mounting plate (13) and to which the cover (12) is fixed, wherein the retaining part (16) is panel shaped and has at least two protruding webs (17) extending from the retaining part, said webs being inclined relative to a plane of the mounting plate at angle between 20° and 70°.

2. The guide device according to claim 1, wherein the cover (12) comprises a protrusion which is formed with a rounded surface and which engages in a U-shaped receptacle on the catch (5).

3. The guide device according to claim 2, wherein the metal support part (11) is arranged at least partially within the cover (12) and within the U-shaped receptacle of the catch (5).

4. The guide device according to claim 1, wherein the cover (12) has two spaced-apart protrusions, and each protrusion is configured to bear at one side against a contact surface of the catch (5).

5. The guide device according to claim 1, wherein the cover (12) is produced by overmoulding around the metal support part (11).

6. The guide device according to claim 1, wherein the retaining part (16) has an opening (18) which is filled with plastic.

7. The guide device according to claim 1, wherein the webs are arranged at least partially within the cover (12) and within a U-shaped receptacle of the catch (5).

8. The guide device according to claim 1, wherein the webs are designed to be elastically deformable so as to be able to absorb the impact energy when striking against the catch (5).

9. A pull-out guide (1) having a guide device according to claim 1.

10. The pull-out guide according to claim 9, wherein the metal support part (11) is welded onto a moveable rail (3) or a stationary rail (2) of the pull-out guide (1).

* * * * *